US005344201A

United States Patent [19]

Offin

[11] Patent Number: 5,344,201

[45] Date of Patent: Sep. 6, 1994

[54] MULTI-FUNCTION TOOL FOR TRUCK OPERATORS

[76] Inventor: A. Dean Offin, 12623 SE. 42nd St., Bellevue, Wash. 98006

[21] Appl. No.: 90,889

[22] Filed: Jul. 12, 1993

[51] Int. Cl.[5] ..... B25F 1/00

[52] U.S. Cl. ..... 294/24; 294/19.1; 294/26

[58] Field of Search ..... 294/19.1, 24, 26; 7/100; 135/910, 911

[56] References Cited

U.S. PATENT DOCUMENTS

| | | | |
|---|---|---|---|
| 2,198,082 | 4/1940 | Harty | 135/910 X |
| 3,644,951 | 2/1972 | Colburn | 294/24 X |
| 3,843,981 | 10/1974 | Verest | 294/24 X |
| 3,937,512 | 2/1976 | Baughman | 294/19.1 |
| 4,050,107 | 9/1977 | Parma | 7/100 |
| 4,251,089 | 2/1981 | Skaggs . | |
| 4,691,465 | 9/1987 | Dooley | 294/26 X |
| 4,778,181 | 10/1988 | Arney | 294/26 X |
| 5,201,559 | 4/1993 | Boring et al. | 294/19.1 |

*Primary Examiner*—Dean J. Kramer
*Attorney, Agent, or Firm*—Hughes, Multer & Schacht

[57] ABSTRACT

A tool for allowing an operator of a tractor/trailer vehicle to perform routine non-driving duties associated with the operation of such tractor/trailer vehicles. The tool comprises an elongate central portion, a handle portion, a hook portion, and a prying portion. The hook portion is used to displace a fifth wheel pin of the tractor/trailer vehicle to disconnect the tractor from the trailer. The prying portion is used to loosen sticky hydraulic landing gear of such vehicles. The central portion may be tapped against the tires of the tractor/-trailer vehicle to check the air pressure thereof. Reflective material may be formed on the tool.

3 Claims, 4 Drawing Sheets

MULTI-FUNCTION TOOL FOR TRUCK OPERATORS

TECHNICAL FIELD

The present invention relates to tools employed by truck operators and, more particularly, to such tools used to release a fifth wheel pin of a tractor/trailer assembly.

BACKGROUND OF THE INVENTION

In the normal case, a truck operator's primary responsibility is to drive the tractor/trailer, while a truck mechanic performs repair and maintenance on such tractor/trailers. However, the truck operator is often called upon to perform minor duties such as disconnecting the tractor from the trailer, checking the tire air pressure, and raising and lowering the hydraulic landing gear when a trailer is disconnected from a tractor. These duties are separate from the repair and maintenance duties performed by a truck mechanic or the like.

Unlike a mechanic, truck operators do not have a full complement of tools available for performing their duties. Most of the minor duties performed by the truck operator are performed by hand. For example, the truck operator is often called on to disconnect or uncouple a fifth wheel pin employed to connect the trailer to the tractor. The fifth wheel pin is located between the tractor and the trailer above the rear tires of the tractor. The truck operator is expected to bend down and reach between the tractor and the trailer past one set of rear tires to pull the fifth wheel pin. This action requires operators to contort themselves into an awkward position while pulling the pin and often results in the operators straining any number of body parts, such as shoulders, elbows, and wrists and especially their backs.

While most of the non-driving duties of the operator are performed by hand, one tool commonly employed by truck operators is a "butt bar." A butt bar is a straight piece of metal approximately one to two feet in length with which the operator bangs on the tires of the tractor/trailer to test the air pressure in the tires.

Additionally, it is believed that some operators have attached a hook to their butt bars; these hooks allow the operator to use the butt bar to pull the fifth wheel pin, but this is only a marginally effective tool because butt bars do not have a handle; the operators must therefore grip the bar with two hands and press their faces against the trailer to develop sufficient leverage on "tough pulls." Obviously, the truck operator must still bend over into an awkward position to pull the the fifth wheel pin.

Also, tools having a thin shaft and a hook on the end thereof have been used to pull fifth wheel pins, but these tools are awkward to use and store and are used only for a single purpose: removing fifth wheel pins.

Another duty performed by truck operators is the raising and lower of hydraulic landing gear on which the trailer rests when it is not hooked up to the tractor. As mentioned, these landing gear are often hydraulically operated. In some cases, however, the landing gear "stick" and do not raise properly. This sticking is the result of debris on the exposed leg and/or problems with the hydraulic system. As a mechanic is not always available, when the landing gear stick, it is often necessary to loosen the sticky landing gear by prying on the ground contacting portion of the landing gear with a screw driver, crow bar, or the like to raise the landing gear an inch or so. Butt bars often have a flattened tip for this purpose. Once the landing gear is so raised a small distance, the hydraulic system is usually able to raise the landing gear the remaining portion.

PRIOR ART

The applicant is aware of U.S. Pat. No. 4,251,089 issued Feb. 17, 1981 to Skaggs. The Skaggs patent discloses a tool for decoupling a tractor from a trailer by pulling a fifth wheel pin. This tool comprises a lever bar and a hooked link rod having hinged first and second links. In use, the hook of the link rod is placed over the fifth wheel pin while the lever bar is braced on the tire. The lever bar is pulled away from the fifth wheel pin; the link rod is connected to the lever bar such that pulling on the lever bar displaces the link rod to remove the fifth wheel pin. This tool would not work on modern tractor/trailers because the fifth wheel pin is located slightly rearwardly of the tires, which prevent the lever bar from being braced on these tires. Further, this device does not address any of the other problems described above. To the Applicant's knowledge, the Skaggs device is not presently on the market.

OBJECTS OF THE INVENTION

From the foregoing it should be apparent that a primary object of the present invention is to provide improved tools for allowing truck operators to perform their duties.

Another important, but more specific, object of the present invention is to provide a tool for truck operators that provides a favorable mix of the following factors:

a. facilitating the removal of the fifth wheel pin;
b. allowing operators to check the air pressure in the tires of their vehicles;
c. allowing operators to loosen sticky hydraulic landing gear;
d. improving the safety of the operator's working environment;
e. inexpensive to fabricate; and
f. easy to use.

Additional objects and advantages of the present invention will become apparent from the following description and accompanying drawings.

SUMMARY OF THE INVENTION

There has been invented, and disclosed herein, a new and novel tool for use by truck operators. This tool comprises an elongate portion, a handle portion substantially orthogonally extending from a first end of the elongate portion, and a hook portion attached adjacent to a second end of the elongate portion. The hook portion is placed around a fifth wheel pin employed to connect a tractor to a trailer from either above or below. The handle is then grasped and displaced in the direction of the axis of the fifth wheel pin to remove the fifth wheel pin from the position in which it locks the tractor to the trailer.

The distance between the hook and the handle is preferably at least 24 inches so that the operator may comfortably reach the fifth wheel pin without having to bend over or reach far between the tractor and the trailer.

The second end of the elongate portion is preferably formed into a prying portion. This prying portion has at least one flattened surface. The prying portion may be used to loosen sticky hydraulic landing gear on the trailer. The flattened surface is preferably so arranged relative to the handle that the handle extends in a direction substantially parallel to horizontal when the landing gear is being loosened; this allows the operator to apply maximum leverage to the tool when loosening the landing gear.

Further, by tapping the tires of the tractor/trailer with the elongate portion by, for example, grasping the handle of the tool, the operator can check the air pressure with the tires.

Additionally, a reflective material is preferably formed on the elongate portion.

From the foregoing, it should be clear that, with one tool constructed as just described, the truck operator can easily perform all of the non-driving duties normally performed by the truck operator. Not only can the operator perform these duties, but the tool of the present invention increases the safety of the operator's work environment. In particular, the tool of the present invention decreases the likelihood that operators will injure their backs while pulling the fifth wheel pin. The reflective material on this tool also increases the visibility of the operator at night, decreasing the likelihood that operators will be struck by other vehicles while working around their vehicles.

DETAILED DESCRIPTION OF THE INVENTION

Figure 1:
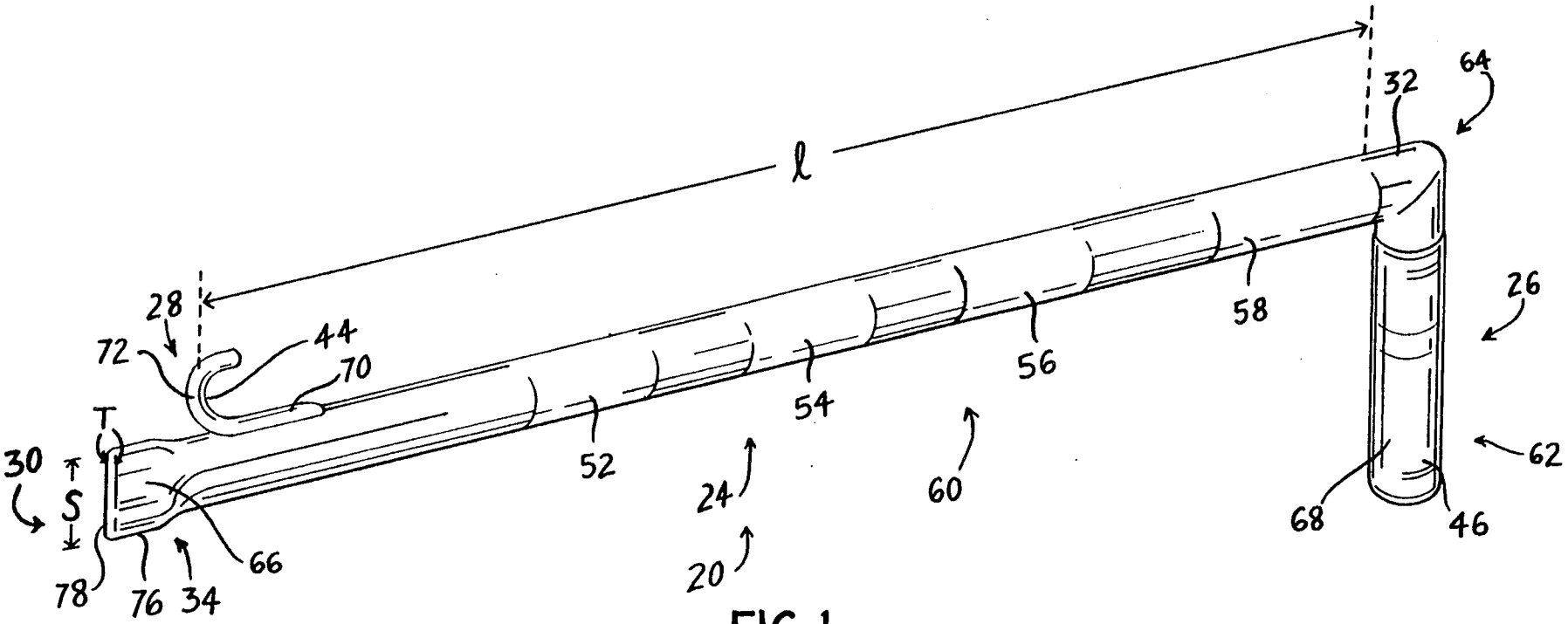
FIG. 1 is a perspective view of an exemplary tool constructed in accordance with the present invention.

Referring now to FIG. 1 of the drawing, generally depicted at 20 therein is a tool for aiding a truck operator 22 (FIGS. 2 and 4) in his non-driving duties.

The tool 20 basically comprises a central elongate portion 24, a handle portion 26, a hook 28, and a prying portion 30. The handle portion 26 orthogonally extends from a first end 32 of the central portion 24. The hook 28 is mounted adjacent to a second end 34 of the central portion 24. The prying portion 30 is integrally formed on the second end 34 of the central portion 24.

Figure 2:
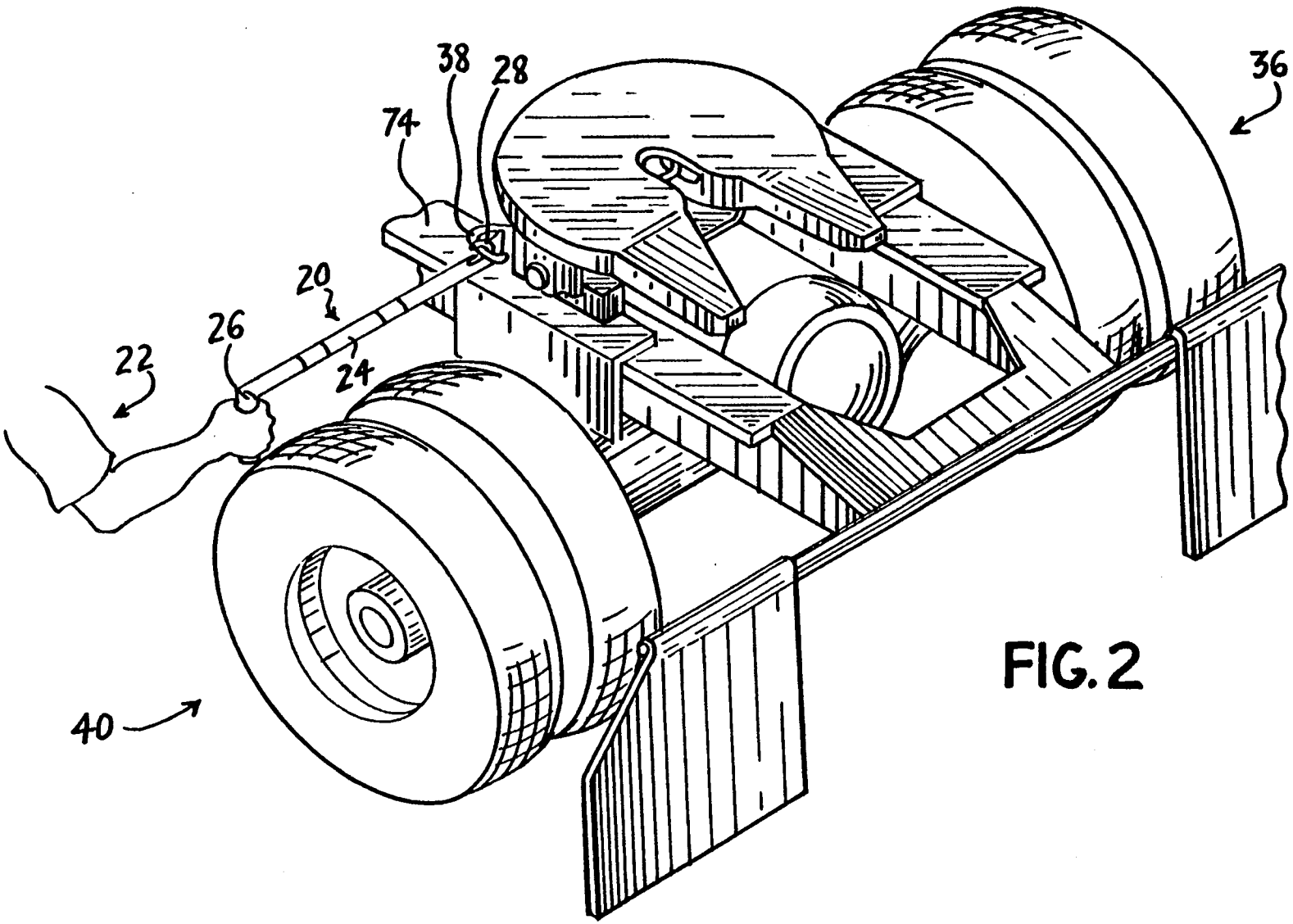
FIG. 2 is a perspective view depicting the tool shown in FIG. 1 being used to remove a fifth wheel pin.

Referring now to FIG. 2, depicted therein is a portion 36 of a tractor of a tractor/trailer vehicle. So that the operation of the present invention may be illustrated clearly, the trailer of the tractor/trailer vehicle is not shown in FIG. 2.

FIG. 2 depicts the tool 20 described above being used to remove a fifth wheel pin 38 such as is normally employed to connect the tractor of the tractor/trailer vehicle to the trailer thereof. The operator 22 removes the fifth wheel pin 38 by hooking the pin 38 with hook portion 28 of the tool 20, firmly grasping the handle portion 26 of the tool 20, and pulling the tool 20 and thus the fifth wheel pin 38 engaged thereby.

Figure 3:
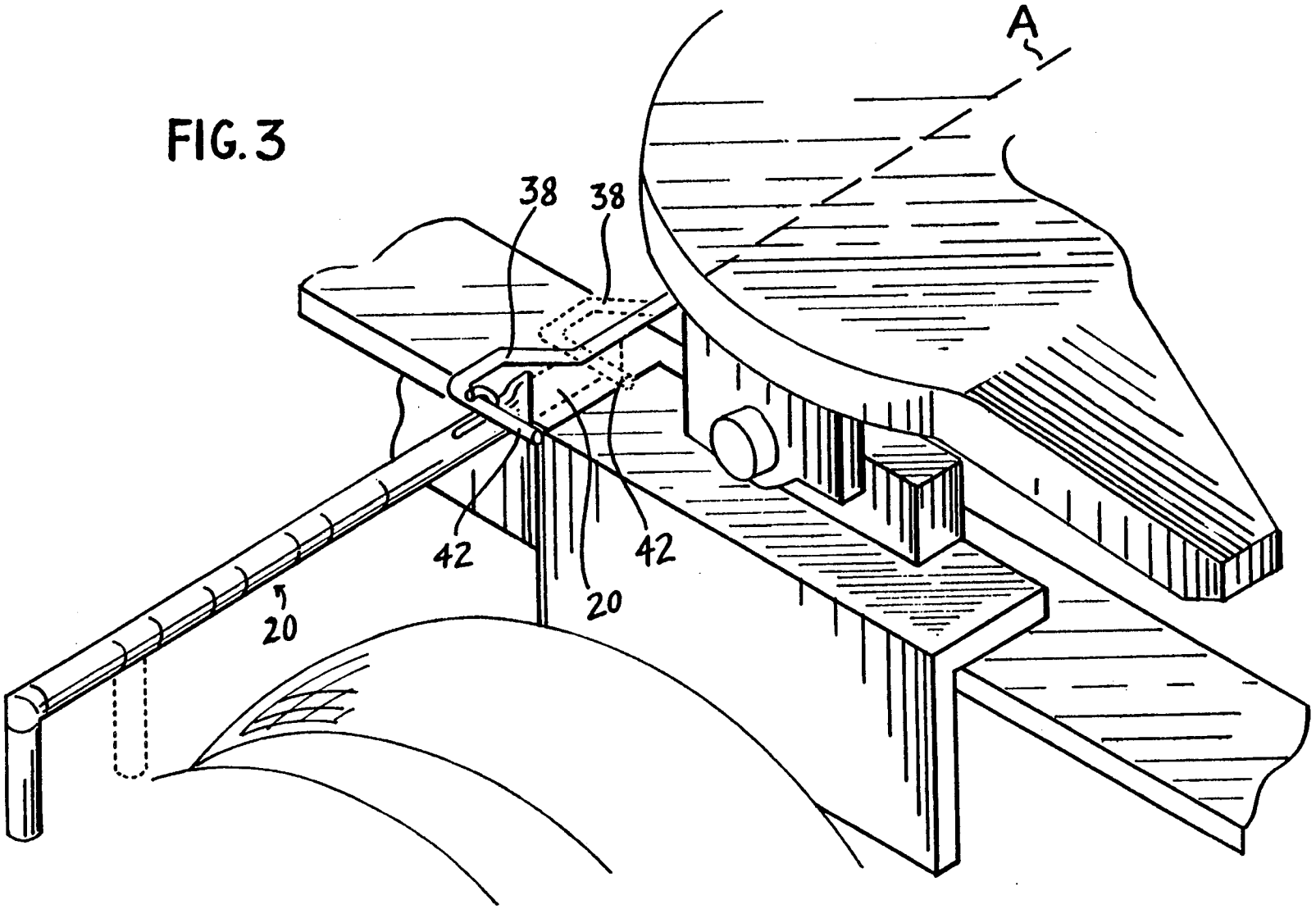
FIG. 3 is a close-up perspective view depicting the situation in FIG. 2, in which the fifth wheel pin is shown in its inserted position (dotted lines) and in its removed position (solid lines)

This process is depicted more clearly in FIG. 3. Shown by dotted lines in FIG. 3 is the fifth wheel pin 38 in its engaged position in which it connects the tractor to the trailer. A dotted line also depicts the tool 20 in the position where the hook portion 28 hooks the pin 38 when the pin 38 is in the engaged position. The fifth wheel pin 38 is shown in its released position by solid lines in FIG. 3; similarly, a solid line depicts the tool 20 after it has been pulled to move the pin 38 into its released position.

FIG. 3 also shows that the fifth wheel pin 38 has an axis A along which it is displaced between the engaged and released positions. The pin 38 also has a grasping projection 42 extending transverse to the pin axis A; this grasping projection 42 is designed to be grasped by the operator 22 to facilitate movement of the pin 38 from the engaged position to the released position. However, the hook portion 28 of the tool 20 is adapted to hook the grasping projection 42 to allow the tool 20 to be used to remove the pin 38.

Referring for a moment back to FIG. 2, that Figure also shows that, with the tool hook 28 thereof engaging the fifth wheel pin 38, the tool handle 26 is located adjacent to the outermost edge of the wheels 40 of the tractor portion 36; in other words, the central portion 24 of the tool 20 should be of sufficient length that the operator 22 can grasp the handle 26 and pull the tool 28 away from the fifth wheel pin 38 without reaching too far under the trailer and without interference by the wheels 40.

With the central portion 24 properly dimensioned as just described, the operator 22 need not reach under the trailer to remove the fifth wheel pin 38. This prevents the operator 22 from having to contort himself into an awkward position in order to pull the pin 38, thereby greatly alleviating the risk that the operator 22 will injure himself when removing the pin 38.

Referring for a moment back to FIG. 1, the Applicant has determined that the minimum acceptable distance l between an inner diameter 44 of the hook portion 28 and a surface 46 of the handle 26 is 20 inches and that the maximum acceptable distance 1 is approximately 28 inches. By keeping the distance 1 between these limits, the fifth wheel pin of most tractor/trailer vehicles can easily be pulled while allowing the weight and bulk of the tool 20 to be kept to a minimum.

Figure 4:
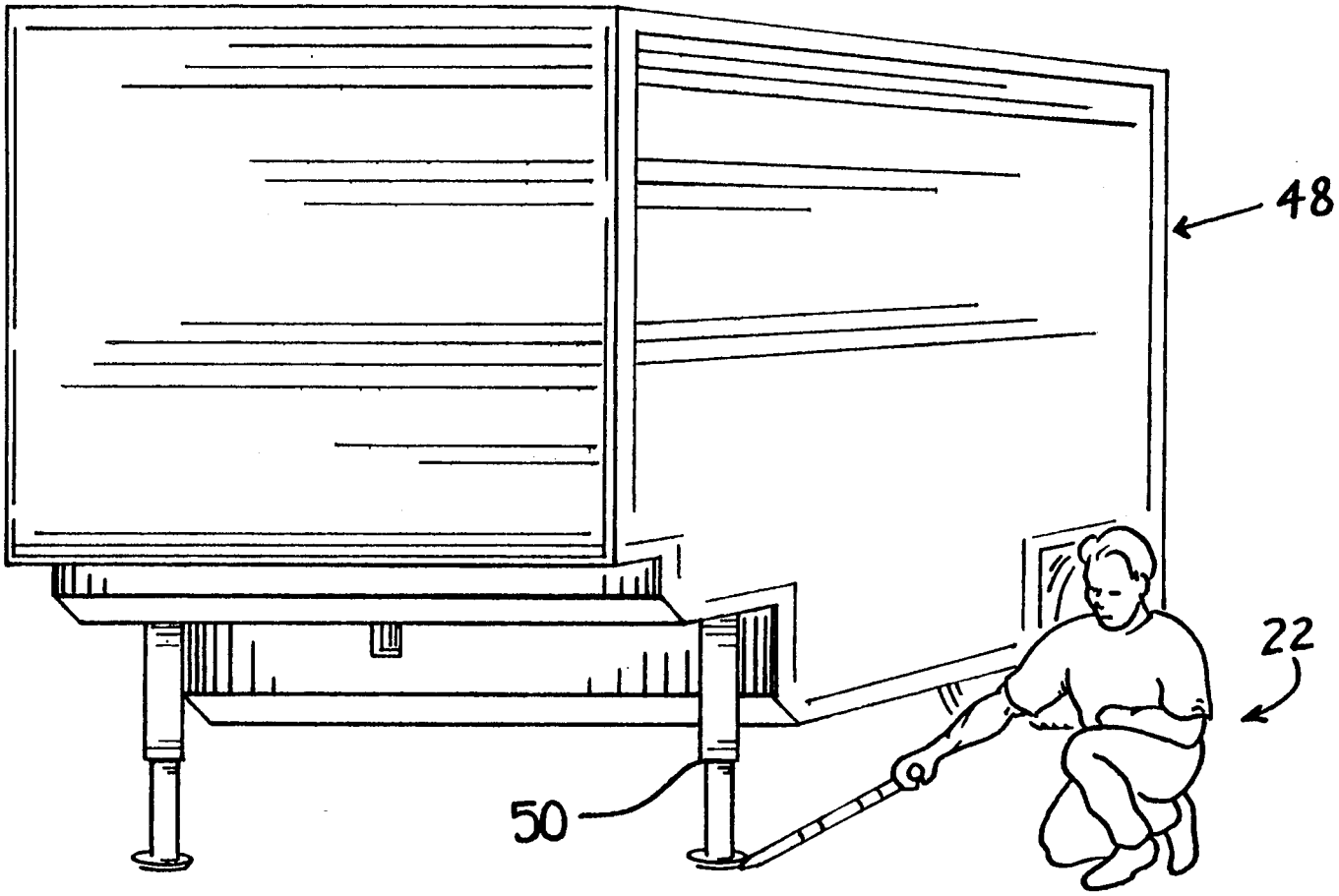
FIG. 4 is a perspective view showing the tool depicted in FIG. 1 being used to loosen a sticky hydraulic landing gear.

Referring now to FIG. 4, depicted therein is the trailer 48 of a tractor/trailer vehicle. The trailer 48 has landing gear generally depicted at 50. The tool 20 is being used in that Figure to loosen the landing gear 50 so that they may be retracted. In particular, the prying portion 30 is inserted and rotated, twisted, or levered as necessary to free the landing gear 50. The rotation, twisting, or levering motion required is applied between a lower portion of the landing gear 50 and the ground on which the gear 50 rests to raise the landing gear 50 relative to the ground.

The operator 22 may also use the tool 20 to check the pressure of the tires of a tractor/trailer vehicle by grasping the handle portion 26 and tapping a tire with the second end 34 of the central portion 24. When checking tire pressure in this manner, the Applicant has found that tapping a tire with the central portion second end 34 instead of the hook portion 28 or the prying portion 30 is most efficient.

Again referring to FIG. 1, it can be seen therein that reflective stripes 52, 54, 56, and 58 are formed around the circumference of the tool 20. These stripes 52–58 reflect light emanating from approaching vehicles and thus warn the operators of these vehicles or the presence of the person carrying the tool 20. The stripes 52–58 thus increase the safety of the work environment for the vehicle operator 22.

The details of construction of the tool 20 will now be described in further detail. As best shown in FIG. 1, the exemplary tool 20 is comprised of first and second sections of steel pipe generally indicated by reference characters 60 and 62. These pipe sections 60 and 62 are joined by a 45° miter joint 64.

The overall length of the second pipe section 62 is normally between 20% and 25% of the overall length of the first pipe section 60. The overall length of the first pipe section 60 is generally the length 1 described above plus an amount sufficient to allow the prying portion 30 to extend past the hook portion 28 and to allow the formation of the mitre joint 64.

The distance that the tip of the prying portion 30 extends beyond the hook portion 28 is generally between one-half and four inches. The prying portion has a first flat surface 66 and a second flat surface (not shown) that are formed by heating an end of the pipe section 60 and pinching this end. The span S (FIG. 1) of the prying portion 30 should be between one and two inches to allow a full range of prying. The thickness T of the prying portion 30 should be between three and six milimeters.

The distance necessary to form the mitre joint 64 is calculated from the diameters of the pipe sections 60 and 62. The pipe sections are formed of steel in the exemplary tool 20. The outer diameters of the exemplary pipe sections 60 and 62 are preferably the same and are between three-quarters and one and one-half inches in the exemplary tool 20. The pipe sections 60 and 62 of the exemplary tool 20 are welded together.

The handle portion 26 is formed by the second pipe section 62. The 45° mitre joint 64 causes the handle to extend at a substantially right angle from the central portion 24, as was discussed briefly above. The handle portion 26 is coated with a layer 68 of material designed to enhance the ability of the operator 22 to grip the handle 26.

The hook portion 28 is a piece of high strength wire or roundstock that is bent such that it has a short shaft 70 and a curved or hooked portion 72. The short shaft 70 is welded or otherwise securely fastened to the first pipe section 60 such that the above-discussed inner diameter 44 of the curved portion 72 faces the handle portion 26.

The hook portion 28 is either formed on an opposite side of the first pipe section 60 from the handle portion 26 as shown in FIG. 1 or on the same side as this handle portion 26. The hook portion 28 is either lined up with the handle portion 26 or on the opposite side of the handle portion 26 so that the operator 22 knows when the hook portion 28 will engage the fifth wheel pin by the position of the handle portion 26; that is, the hook portion 28 will engage the pin when the handle portion 26 is extending straight up or straight down, depending upon whether the hook portion 28 is on the same or opposite side, respectively as the handle portion.

The placement of the handle portion 26 relative to the hook portion 28 is chosen based on which position is more comfortable for a given operator. For example, tall operators may prefer the hook portion 28 on the same side as the handle portion 26 because the handle will be extending upwardly when the fifth wheel pin is removed. Shorter operators, on the other hand, may prefer the opposite situation because the handle portion 26 is lower when it is grasped and pulled.

An interesting feature unexpectedly resulting from the combination of the hook portion 28 and the prying portion 30 is that the prying portion 30 will often contact a surface on the tractor 36 such as the surface identified by reference character 74 in FIGS. 2 and 3. This surface 74 is located adjacent to and just below the fifth wheel pin 38. The distance between a contacting edge 76 (FIG. 1) of the prying portion 30 opposite the hook portion 28 and the hook portion 28 should be such that, when the contacting edge 76 rides on the surface 74, the hook portion 28 is exactly or closely vertically aligned with the grasping projection 42 of the fifth wheel pin 38. The operator 22 need only arrange the tool 20 such that the contacting edge 76 rides on the surface 74 and then pull back until the hook portion 28 engages the grasping projection 42. In certain circumstances, this can be accomplished without the operator 22 even viewing the fifth wheel pin 38, further reducing the possibility that the operator 22 will injure himself.

It should be noted that, in order to form an engaging edge 76 on the prying portion 30 as just described, a prying edge 78 of the exemplary prying portion 30 is arranged so that it is substantially parallel to the handle portion 26.

It should be noted that the reflective stripes 52–58 can be formed in countless configurations such as in a logo and by many different materials such as reflective tape or reflective paint.

The tool 20 of the present invention and its method of use eliminate the need for the operator to carry more than one tool, reduce the likelihood that operators will injure themselves, allow the operator's non-driving duties to be performed in a more efficient manner, and achieve all these benefits in a single inexpensive, compact tool.

From the foregoing, it should be clear that the present invention can be embodied in forms other than described above. The above-described embodiment is therefore to be considered in all respects illustrative and not restrictive, the scope of the invention being indicated by the appended claims rather than the foregoing description. All changes that come within the meaning and scope of the claims are intended to be embraced therein.

I claim:

1. A method of performing routine non-driving duties associated with tractor/trailer vehicles, comprising the steps of:

a. providing a tool having
   i. an elongate central portion,
   ii. a handle portion projecting from a first end of the elongate central portion, and
   iii. a hook portion attached adjacent to a second end of the elongate central portion, the hook portion being adapted to engage a grasping projection of a fifth wheel pin of the tractor of the tractor/trailer vehicle, where a length of the central portion between the handle portion and the hook portion being such that, when the hook portion engages the grasping projection, the handle portion may be easily grasped and pulled by the operator;

b. grasping the handle portion of the tool;

c. arranging the tool such that the hook portion is adjacent to the grasping projection;

d. pulling the tool such that the hook portion engages and displaces the grasping projection in a manner that causes the fifth wheel pin to move from an engaged position into a released position.

e. providing the tool such that the tool has a prying portion formed on the second end of the central portion; and f. prying landing gear of a trailer portion of the tractor/trailer vehicle to loosen the landing gear.

2. A method as recited in claim 1, further comprising the step of tapping on tires of the tractor/trailer vehicle to check air pressure thereof.

3. A method as recited in claim 1, further comprising the steps of:

a. providing the tool such that the tool has an engaging edge formed thereon; and b. arranging the hook portion adjacent to the grasping projection by placing the engaging edge on a surface of the trailer of the tractor/trailer vehicle.

* * * * *